US008192535B2

(12) United States Patent
Tanaka et al.

(10) Patent No.: US 8,192,535 B2
(45) Date of Patent: Jun. 5, 2012

(54) DUST COLLECTOR

(75) Inventors: Toshio Tanaka, Osaka (JP); Kanji Motegi, Osaka (JP); Ryuji Akiyama, Osaka (JP); Tsunahiro Odo, Osaka (JP); Shunji Haruna, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 750 days.

(21) Appl. No.: 12/304,615

(22) PCT Filed: Jun. 15, 2007

(86) PCT No.: PCT/JP2007/062150

§ 371 (c)(1),
(2), (4) Date: Dec. 12, 2008

(87) PCT Pub. No.: WO2007/145330

PCT Pub. Date: Dec. 21, 2007

(65) Prior Publication Data

US 2009/0277332 A1 Nov. 12, 2009

(30) Foreign Application Priority Data

Jun. 15, 2006 (JP) ..... 2006-165680

(51) Int. Cl.
*B03C 3/47* (2006.01)
*B03C 3/64* (2006.01)

(52) U.S. Cl. ..... 96/98

(58) Field of Classification Search ..... 96/94–100
See application file for complete search history.

(56) References Cited

U.S. PATENT DOCUMENTS 5,322,550 A * 6/1994 Park ..... 96/66
5,456,741 A * 10/1995 Takahara et al. ..... 96/22
5,622,543 A * 4/1997 Yang ..... 96/58
5,820,660 A * 10/1998 Ko ..... 96/30
6,090,189 A * 7/2000 Wikstrom et al. ..... 96/69
6,126,727 A * 10/2000 Lo ..... 96/39
6,506,238 B1 * 1/2003 Endo ..... 96/79

FOREIGN PATENT DOCUMENTS

| | | | |
|---|---|---|---|
| EP | 1 291 086 | | 3/2003 |
| JP | 37-1790 | | 2/1962 |
| JP | 46-8920 | | 3/1971 |
| JP | 62-053751 | | 3/1987 |
| JP | 62-183560 | | 11/1987 |
| JP | 1-124244 | U | 8/1989 |
| JP | 02-83042 | | 6/1990 |
| JP | 8-71451 | A | 3/1996 |
| JP | 10-513118 | A | 12/1998 |
| JP | 2000-84435 | A | 3/2000 |
| JP | 2001-121033 | A | 8/2001 |
| JP | 2003-019444 | | 1/2003 |
| JP | 2007-007589 | A | 1/2007 |
| KR | 20-0302935 | Y1 | 2/2003 |
| WO | WO-96/24437 | A1 | 8/1996 |

* cited by examiner

*Primary Examiner* — Richard L Chiesa
(74) *Attorney, Agent, or Firm* — Birch, Stewart, Kolasch & Birch, LLP

(57) ABSTRACT

A dust collector includes a charging part (12) for charging dust with electricity and a dust collecting part (30). Each of a dust collecting electrode (40) and a high-voltage electrode (50) that constitute the dust collecting part (30) includes: a base (41, 51) with a rectangular grid structure having a large number of vent holes (46, 56) formed therein; and projections (42, 52) extending into the vent holes (56, 46) of the opposed electrode (50, 40). The dust collector collects dust by generating an electric field between the dust collecting electrode (40) and the high-voltage electrode (50).

13 Claims, 7 Drawing Sheets

DUST COLLECTOR

This application is a National Stage of International Application No. PCT/JP2007/062150, filed on Jun. 15, 2007.

TECHNICAL FIELD

This invention relates to dust collectors and particularly relates to their electrode structures.

BACKGROUND ART

Conventional dust collectors include a dust collector that includes a charging part for charging dust with electricity and a dust collecting part having dust collecting electrodes and high-voltage electrodes, as disclosed in Patent Document 1. The dust collecting electrodes and the high-voltage electrodes of the dust collecting part are composed of parallel flat plates, wherein each dust collecting electrode is inserted between adjacent two of the high-voltage electrodes.

The dust collector is configured to charge dust in the air with electricity at the charging part while generating an electric field between each pair of adjacent dust collecting electrode and high-voltage electrode, whereby the dust collecting part collects the dust charged with electricity at the charging part.

Patent Document 1: Published Japanese Patent Application No. H08-71451

DISCLOSURE OF THE INVENTION

Problems to be Solved by the Invention

Since in the above conventional dust collector the dust collecting electrodes and the high-voltage electrodes of the dust collecting part are made of a resin but composed of parallel flat plates, this makes it difficult to downsize the dust collector and also makes it difficult to enhance the performance. More specifically, since the dust collecting electrodes are composed of flat plates and simply arranged in parallel, this causes a problem that the dust collection area in the limited space in the dust collector is small. Therefore, in order to ensure a certain degree of dust collection capacity, the dust collector must be increased in size. This provides poor performance in proportion to the size.

The present invention has been made in view of the foregoing points and, therefore, an object of the present invention is to downsize the dust collector and enhance its performance.

Means to Solve the Problems

A first aspect of the invention is directed to a dust collector, including a first electrode (40) and a second electrode (50), for collecting electrically charged dust by applying a predetermined voltage between the first electrode (40) and the second electrode (50). Furthermore, at least one of the first electrode (40) and the second electrode (50) is made of an electroconductive resin. The first electrode (40) is configured to surround the second electrode (50).

A second aspect of the invention is directed to a dust collector, including a first electrode (40) and a second electrode (50) that are placed in an air passage (23), for collecting electrically charged dust by applying a predetermined voltage between the first electrode (40) and the second electrode (50). Furthermore, at least one of the first electrode (40) and the second electrode (50) is made of an electroconductive resin.

The first electrode (40) and the second electrode (50) are configured to create a radial electric field in the cross section of the air passage (23).

In the first and second aspects of the invention, since an electric filed generates between the first electrode (40) and the second electrode (50), electrically charged dust in the air is adsorbed, during flow between the first electrode (40) and the second electrode (50), on the electrode having a different polarity, for example, on the surface of the first electrode (40) and thereby collected over a wide dust collection area thereof.

Furthermore, since at least one of the first electrode (40) and the second electrode (50) is made of an electroconductive resin, this prevents the occurrence of spark and it can be easily molded.

A third aspect of the invention is directed to a dust collector, including a first electrode (40) and a second electrode (50), for collecting electrically charged dust in the air by applying a predetermined voltage between the first electrode (40) and the second electrode (50). Furthermore, at least one of the first electrode (40) and the second electrode (50) is made of an electroconductive resin. The first electrode (40) includes a tubular part forming a vent hole (46) opening at the front and back surfaces thereof. In addition, the second electrode (50) has a projection (52) formed thereon to extend at least into the vent hole (46) of the first electrode (40).

In the third aspect of the invention, electrically charged dust in the air flows at least into the vent hole (46) of the first electrode (40). During the flow, since the projection (52) of the second electrode (50) extends into the vent hole (46) of the first electrode (40), an electric field generates between the first electrode (40) and the second electrode (50), so that electrically charged dust is adsorbed on the electrode having a different polarity, for example, on the surface of the tubular part of the first electrode (40) and thereby collected over a wide dust collection area thereof.

Furthermore, since at least one of the first electrode (40) and the second electrode (50) is made of an electroconductive resin, this prevents the occurrence of spark and it can be easily molded.

The electroconductive resin in the first to third aspects of the invention is preferably a mildly electroconductive resin and the volume resistivity of the resin is preferably between $10^8$ Ωcm (inclusive) and $10^{13}$ Ωcm (exclusive).

A fourth aspect of the invention is the dust collector according to the third aspect of the invention, wherein the first electrode (40) is formed in a grid structure having a large number of the vent holes (46) formed therein, and the second electrode (50) has a large number of the projections (52) formed thereon in correspondence with the respective vent holes (46) of the first electrode (40).

In the fourth aspect of the invention, since dust is adsorbed, for example, on the surfaces of the large number of vent holes (46) of the first electrode (40), the dust collector has a wide dust collection area and thereby ensures the collection of dust.

A fifth aspect of the invention is the dust collector according to the fourth aspect of the invention, wherein the first electrode (40) includes: a base (41) with a grid structure having a large number of the vent holes (46) formed therein; and a large number of projections (42) extending from the base (41) in parallel to the axial direction of the vent holes (46). On the other hand, the second electrode (50) includes a base (51) with a grid structure opposed to the base (41) of the first electrode (40) and having a large number of vent holes (56) formed therein to open at the front and back surfaces thereof. Furthermore, the projections (52) of the second electrode (50) project from the base (51) in parallel to the axial direction of the vent holes (56). In addition, the projections (42) of the first electrode (40) extend into the respective vent holes (56) of the second electrode (50).

In the fifth aspect of the invention, since the bases (41, 51) are formed in a grid structure and the projections (42, 52) extend into the respective associated vent holes (56, 46), this provides a wide dust collection area and thereby ensures the collection of dust. A sixth aspect of the invention is the dust collector according to the fifth aspect of the invention, wherein each of the bases (41, 51) of the first electrode (40) and the second electrode (50) is formed in a rectangular grid structure in which a plurality of partitions (44, 54, 45, 55) are crisscrossed.

In the sixth aspect of the invention, since the bases (41, 51) are formed in a rectangular grid structure, this provides a wide dust collection area and thereby ensures the collection of dust.

A seventh aspect of the invention is the dust collector according to the sixth aspect of the invention, wherein each of the vertical partitions (44) of the first electrode (40) is located to form the same plane with an associated one of the vertical partitions (54) of the second electrode (50), and the horizontal partitions (45) of the first electrode (40) and the horizontal partitions (55) of the second electrode (50) are alternately arranged in a vertically staggered pattern.

In the seventh aspect of the invention, the projections (42, 52) extend from the horizontal partitions (45, 55) into the vent holes (56, 46), which ensures a wide dust collection area.

An eighth aspect of the invention is the dust collector according to the sixth aspect of the invention, wherein the projections (42, 52) of each of the first electrode (40) and the second electrode (50) project from the horizontal partitions (45, 55) and each of the vertical partitions (54, 44) of the base (51, 41) of the electrode (50, 40) opposed to the projections (42, 52) is located in a clearance between horizontally adjacent two of the projections (42, 52).

In the eighth aspect of the invention, the projections (42, 52) can surely be placed within the vent holes (56, 46), which ensures a wide dust collection area.

A ninth aspect of the invention is the dust collector according to any one of the first to third aspects of the invention, wherein the first electrode (40) and the second electrode (50) are made of an electroconductive resin.

In the ninth aspect of the invention, since both the first electrode (40) and the second electrode (50) are made of an electroconductive resin, this surely prevents the occurrence of spark and they can be easily molded.

A tenth aspect of the invention is the dust collector according to any one of the first to third aspects of the invention, wherein the first electrode (40) is made of an electroconductive metal and the second electrode (50) is made of an electroconductive resin.

An eleventh aspect of the invention is the dust collector according to any one of the first to third aspects of the invention, wherein the first electrode (40) is made of an electroconductive resin and the second electrode (50) is made of an electroconductive metal.

In the tenth and eleventh aspects of the invention, since one of the first electrode (40) and the second electrode (50) is made of metal, the dust collector can be reduced in thickness as compared with the case where both the electrodes are made of resin.

A twelfth aspect of the invention is the dust collector according to any one of the first to third aspects of the invention and the dust collector further includes a charging part (12) for charging dust in the air with electricity. Furthermore, the first electrode (40) and the second electrode (50) are provided separately from the charging part (12) and constitute a dust collecting part (30) for collecting the dust charged with electricity by the charging part (12).

In the twelfth aspect of the invention, since the charging part (12) and the dust collecting part (30) are formed separately from each other, the polarities, the voltage and the interelectrode distance of the first electrode (40) and the second electrode (50) are set to those suitable to the dust collecting part (30).

A thirteenth aspect of the invention is the dust collector according to any one of the first to third aspects of the invention, wherein the first electrode (40) and the second electrode (50) constitute, as an integral piece, a charging part (12) for charging dust in the air with electricity and a dust collecting part (30) for collecting the dust charged with electricity by the charging part (12).

In the thirteenth aspect of the invention, since the charging part (12) and the dust collecting part (30) are formed integrally, the dust collector can be downsized as a whole.

A fourteenth aspect of the invention is the dust collector according to the third aspect of the invention, wherein the second electrode (50) is made of an electroconductive resin, and the distal end corners of the projections (52) of the second electrode (50) are formed in arcuate shape.

In the fourteenth aspect of the invention, the distal end corners of the projections (52) of the second electrode (50) are prevented from causing abnormal discharge.

Effects of the Invention

According to the present invention, the dust collection area can be increased as compared with the conventional parallel electrodes. As a result, the dust collector can be downsized and its dust collection performance can be enhanced.

Furthermore, since at least one of the first electrode (40) and the second electrode (50) is made of an electroconductive resin, the occurrence of spark can surely be prevented and molding can be facilitated.

Particularly, according to the third aspect of the invention, since the projection (52) of the second electrode (50) extends into the vent hole (46) of the first electrode (40), the dust collection area can be drastically increased as compared with the conventional parallel electrodes.

According to the fourth aspect of the invention, since the first electrode (40) includes a base (41) with a grid structure having a large number of vent holes (46) and the second electrode (50) includes a large number of projections (52), the dust collection area can be drastically increased. As a result, the dust collector can be further downsized and its dust collection performance can be farther enhanced.

According to the fifth aspect of the invention, since each of the first electrode (40) and the second electrode (50) includes: a base (41, 51) with a grid structure having a large number of vent holes (46, 56); and a large number of projections (42, 52), the dust collection area can be increased.

According to the sixth aspect of the invention, since each of the bases (41, 51) of the first electrode (40) and the second electrode (50) is formed in a rectangular grid in which a plurality of partitions (44, 54, 45, 55) are crisscrossed, the peripheral surface of each vent hole (46) of the first electrode (40) can be a dust collecting surface, which drastically increases the dust collection area.

According to the seventh aspect of the invention, since the horizontal partitions (45, 55) of the first electrode (40) and the second electrode (50) are alternately arranged in a staggered pattern, the projections (42, 52) can be extended into the respective associated vent holes (56, 46) of the opposed electrodes (50, 40), which increases the dust collection area.

According to the eighth aspect of the invention, since the vertical partitions (54, 44) of one of the electrodes (50, 40) are located in clearances between horizontally adjacent projections (42, 52) of the opposed electrode, the projections (42, 52) can surely be extended, which increases the dust collection area.

According to the ninth aspect of the invention, since both the first electrode (40) and the second electrode (50) are made of an electroconductive resin, the occurrence of spark can surely be prevented and molding can be facilitated.

According to the tenth and eleventh aspects of the invention, since either one of the first electrode (40) and the second electrode (50) is made of an electroconductive metal, its thickness can be smaller than that of the resin-made electrode. Therefore, the dust collector can be downsized as a whole.

According to the twelfth aspect of the invention, since the charging part (12) and the dust collecting part (30) are formed separately from each other, the polarities, the voltage and the interelectrode distance of the first electrode (40) and the second electrode (50) can be set to those suitable to the dust collecting part (30), which further enhances the dust collection performance.

According to the thirteenth aspect of the invention, since the charging part (12) and the dust collecting part (30) are formed integrally, one electrode can be used for two purposes, which provides an entirely downsized dust collector.

According to the fourteenth aspect of the invention, the distal end corners of the projections (52) of the second electrode (50) can be prevented from causing abnormal discharge.

LIST OF REFERENCE NUMERALS

Figure 1:
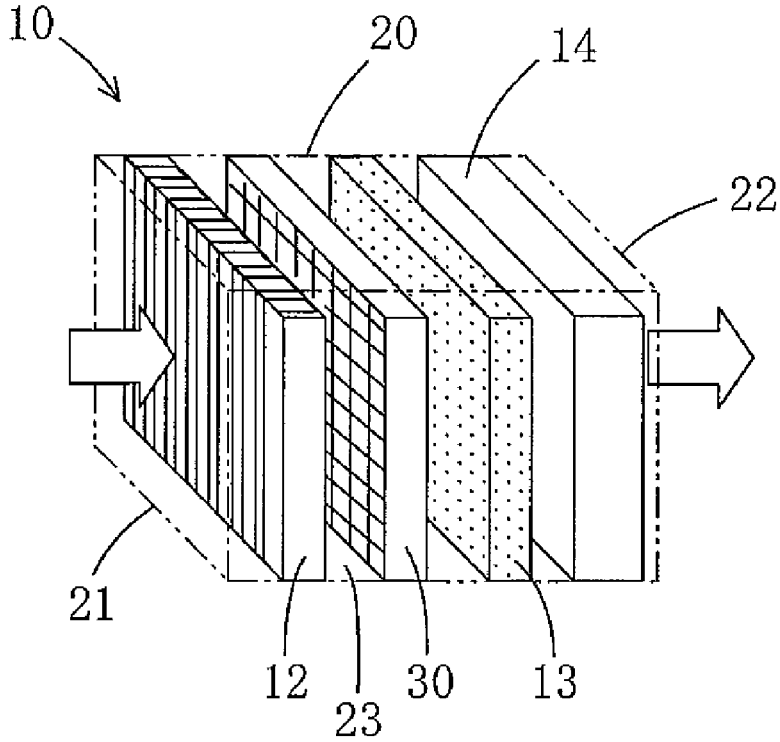
FIG. 1 is a schematic perspective view showing the general structure of an air cleaner according to Embodiment 1 of the present invention.

10 air cleaner
20 casing
12 charging part
12*a* ionizing electrode
30 dust collecting part
40 dust collecting electrode (first electrode)
50 high-voltage electrode (second electrode)
41, 51 base
42, 52 projection
43, 53 frame
44, 54 vertical partition
45, 55 horizontal partition
46, 56 vent hole
52*a* arcuate part

BEST MODE FOR CARRYING OUT THE INVENTION

Embodiments of the present invention will be described below in detail with reference to the drawings.

Embodiment 1

Figure 2:
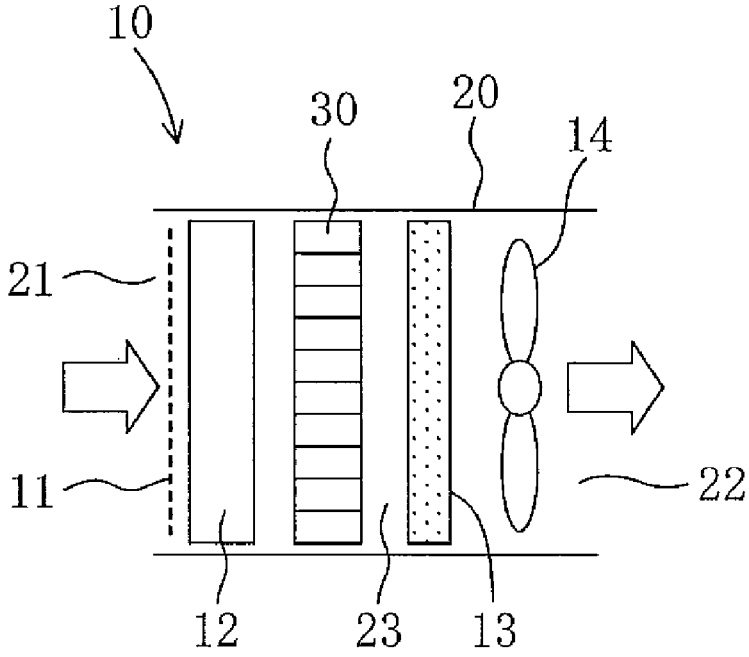
FIG. 2 is a schematic side view showing the general structure of the air cleaner according to Embodiment 1 of the present invention.

As shown in FIGS. 1 and 2, an air cleaner (10) according to this embodiment constitutes a dust collector according to the present invention and is, for example, a household air cleaner used at home or in a small store.

The air cleaner (10) includes a casing (20) and also includes a prefilter (11), a charging part (12), a dust collecting part (30), a catalyst filter (13) and a fan (14) that are contained in the casing (20).

The casing (20) is formed, for example, in a rectangular, horizontally long container. Its front surface forms an air inlet (21), its back surface forms an air outlet (22) and its interior forms an air passage (23). The prefilter (11), the charging part (12), the dust collecting part (30), the catalyst filter (13) and the fan (14) are arranged in this order from the inlet (21) towards the outlet (22).

The prefilter (11) constitutes a filter for collecting relatively large dust in the air taken through the inlet (21) into the casing (20).

The charging part (12) constitutes an ionizer to charge relatively small dust having passed through the prefilter (11) with electricity. For example, although not shown, the charging part (12) is composed of a plurality of ionizing wires and a plurality of opposed electrodes and configured so that a direct-current voltage is applied between each pair of one ionizing wire and one opposed electrode. The ionizing wires are disposed to extend from the upper end to lower end of the charging part (12), and the opposed electrodes are disposed, one between adjacent two of the ionizing wires.

Figure 3:
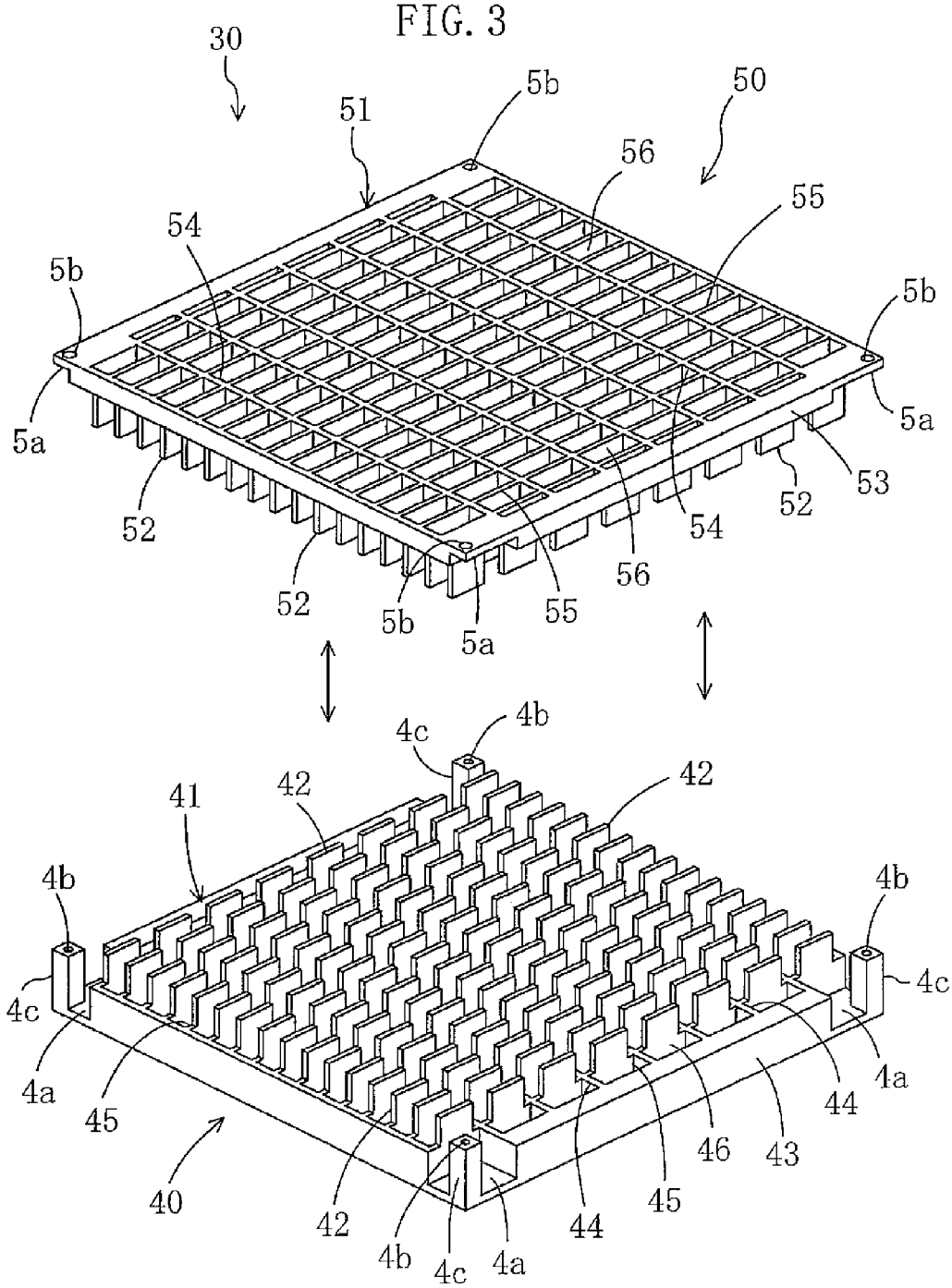
FIG. 3 is a perspective view showing a dust collecting part in Embodiment 1 of the present invention.
Figure 4:
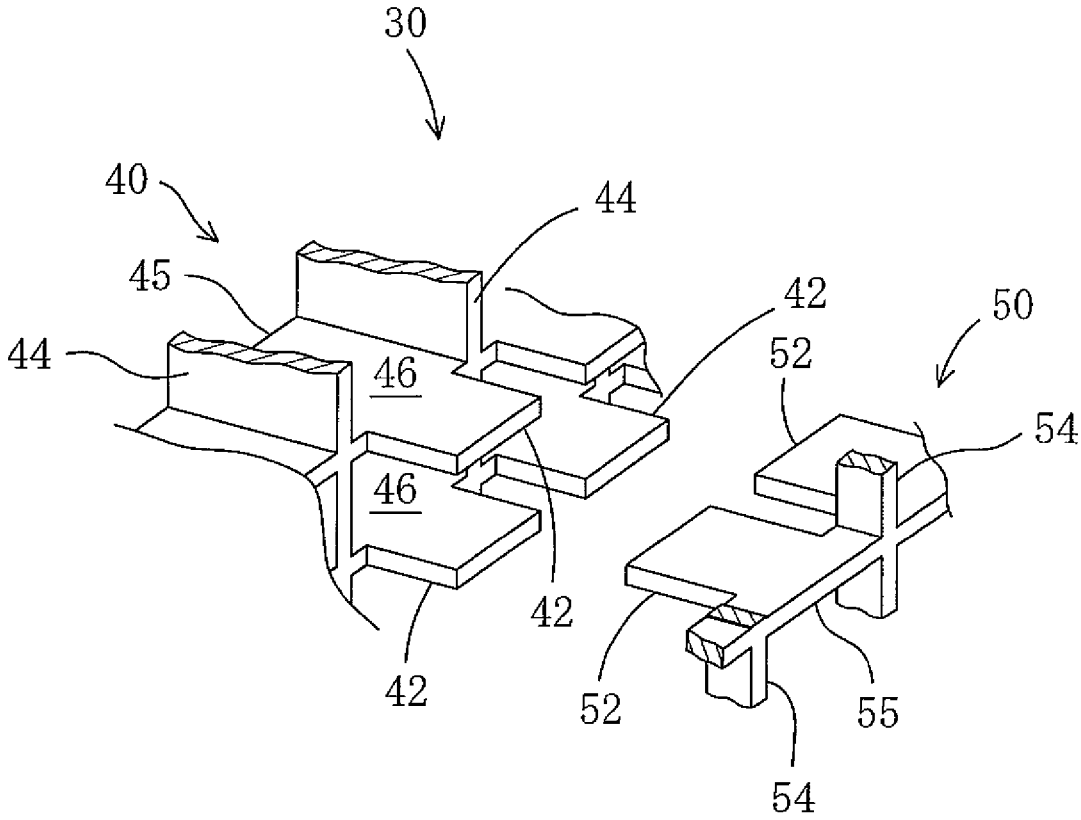
FIG. 4 is a perspective view showing part of the dust collecting part in Embodiment 1 of the present invention in magnified form.
Figure 5:
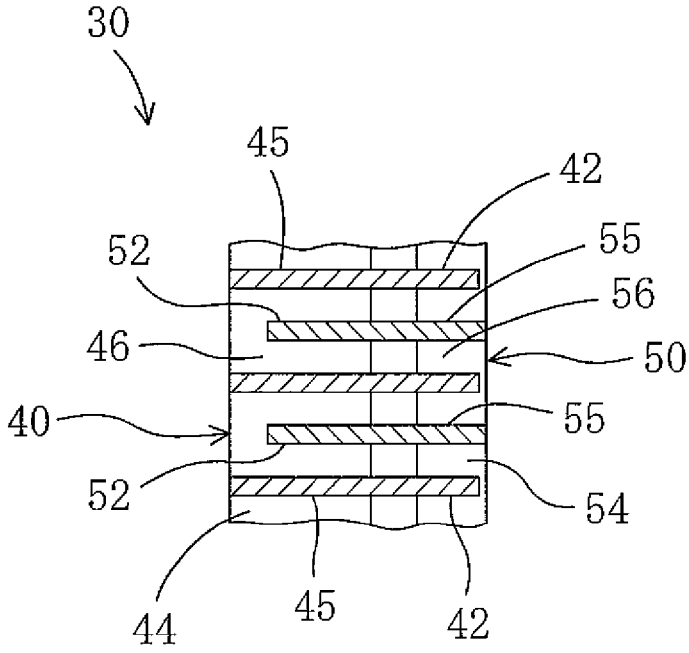
FIG. 5 is a cross-sectional side view showing part of the dust collecting part in Embodiment 1 of the present invention in magnified form.

The dust collecting part (30) is configured to collect dust electrically charged at the charging part (12) by adsorption and includes, as shown in FIGS. 3 to 5, a dust collecting electrode (40) serving as an earth electrode and a high-voltage electrode (50) serving as an anode. Either one of the dust collecting electrode (40) and the high-voltage electrode (50) constitutes a first electrode and the other constitutes a second electrode.

The dust collecting part (30) is a feature of the present invention, wherein the dust collecting electrode (40) and the high-voltage electrode (50) are made of an electroconductive resin and each of them is formed in one piece by integral molding. The dust collecting electrode (40) and the high-voltage electrode (50) are formed in substantially the same shape and configured in an insertion structure in which they can be partly inserted into each other.

Specifically, the dust collecting electrode (40) is configured to surround the high-voltage electrode (50) and the high-voltage electrode (50) is also configured to surround the dust collecting electrode (40). In other words, the dust collecting electrode (40) and the high-voltage electrode (50) are configured to create a radial electric field in the cross section of the air passage (23).

Particularly, the dust collecting electrode (40) and the high-voltage electrode (50) are preferably made of a mildly electroconductive resin and the volume resistivity of the resin is preferably between $10^8$ Ωcm (inclusive) and $10^{13}$ Ωcm (exclusive).

Each of the dust collecting electrode (40) and the high-voltage electrode (50) is formed in a rectangular shape and includes a single base (41, 51) and a large number of projections (42, 52) projecting from the base (41, 51). The base (41, 51) includes a frame (43, 53), a plurality of vertical partitions (44, 54) arranged within the frame (43, 53) and a plurality of horizontal partitions (45, 55) arranged within the frame (43, 53).

The frame (43, 53) is formed in a rectangular shape. The frame (43) of the dust collecting electrode (40) is formed with a larger thickness than the frame (53) of the high-voltage electrode (50). The frame (43) of the dust collecting electrode (40) has thickness-reduced portions (4*a*) formed at its four corners, and the thickness-reduced portions (4*a*) have their respective fixing legs (4*c*) formed thereon and having fixing holes (4*b*). The frame (53) of the high-voltage electrode (50) has thickness-reduced portions (5*a*) formed at its four corners, and the thickness-reduced portions (5*a*) have fixing holes (5*b*) formed therein. The frame (43) of the dust collecting electrode (40) and the frame (53) of the high-voltage electrode (50) are fixed to each other at their four corners (4*a*, 5*a*) through the fixing legs (4*c*), whereby the base (41) of the dust collecting electrode (40) and the base (51) of the high-voltage electrode (50) are disposed to face each other. Furthermore, the bases (41, 51) of the dust collecting electrode (40) and the high-voltage electrode (50) are oriented in a direction orthogonal to the air flow in the air passage (23).

The vertical partitions (44, 54) of the dust collecting electrode (40) and the high-voltage electrode (50) extend in the vertical direction of the casing (20), while the horizontal partitions (45, 55) thereof extend in the horizontal direction of the casing (20). The vertical partitions (44, 54) and the horizontal partitions (45, 55) are arranged to crisscross each other. Each base (41, 51) has a large number of vent holes (46, 56) formed therein and surrounded by the frame (43, 53), the vertical partitions (44, 54) and the horizontal partitions (45, 55). In other words, the base (41, 51) is formed in a rectangular grid structure by the vertical partitions (44, 54) and the horizontal partitions (45, 55), thereby forming a large number of tubular parts to form the vent holes (46, 56).

Each of the vertical partitions (44) of the dust collecting electrode (40) and an associated one of the vertical partitions (54) of the high-voltage electrode (50) are formed to be in the same plane in an assembled state where the base (41) of the dust collecting electrode (40) and the base (51) of the high-voltage electrode (50) are locked with each other. On the other hand, the horizontal partitions (45) of the dust collecting electrode (40) and the horizontal partitions (55) of the high-voltage electrode (50) are formed to be alternately arranged in a vertically staggered pattern in FIG. 5 in the assembled state where the base (41) of the dust collecting electrode (40) and the base (51) of the high-voltage electrode (50) are locked with each other. In other words, the horizontal partitions (45) of the dust collecting electrode (40) are located in the middle of the vent holes (56) of the high-voltage electrode (50), while the horizontal partitions (55) of the high-voltage electrode (50) are located in the middle of the vent holes (46) of the dust collecting electrode (40).

The projections (42, 52) are integrally formed with the associated horizontal partitions (45, 55) to project from them. The projections (42, 52) are formed into projecting pieces in the shape of a flat plate having the same thickness as the horizontal partitions (45, 55) and extend towards the inside of the associated vent holes (56, 46) of the opposed electrodes (50, 40). Furthermore, the projections (42, 52) are formed so that each of the vertical partitions (54, 44) of the opposed electrode (50, 40) is located in a clearance between horizontally adjacent two of the projections (42, 52).

The projections (42, 52) are each located in the middle of the associated vent hole (56, 46) in the assembled state where the base (41) of the dust collecting electrode (40) and the base (51) of the high-voltage electrode (50) are locked with each other, whereby air flows above and below the projections (42, 52). Each projection (42) of the dust collecting electrode (40) and the adjacent projection (52) of the high-voltage electrode (50) are configured to have a distance of 1.0 mm to 2.0 mm between them. For example the distance is preferably 1.2 mm.

The vertical partitions (44) of the dust collecting electrode (40) and the vertical partitions (54) of the high-voltage electrode (50) are located a predetermined distance apart from and without contact with each other in the assembled state where the base (41) of the dust collecting electrode (40) and the base (51) of the high-voltage electrode (50) are locked with each other.

In other words, each projection (42) of the dust collecting electrode (40) is surrounded by the associated vertical partitions (54) and horizontal partitions (55) of the high-voltage electrode (50) and has equal distances from the surrounding vertical partitions (54) and horizontal partitions (55), thereby creating a radial electric filed in the cross section of the associated vent hole (56). Furthermore, each projection (52) of the high-voltage electrode (50) is surrounded by the associated vertical partitions (44) and horizontal partitions (45) of the dust collecting electrode (40) and has equal distances from the surrounding vertical partitions (44) and horizontal partitions (45), thereby creating a radial electric filed in the cross section of the associated vent hole (46).

A direct-current voltage is applied between the dust collecting electrode (40) and the high-voltage electrode (50) to create an electric field between them, whereby electrically charged dust is adsorbed on the dust collecting electrode (40).

Although not shown, the catalyst filter (13) is formed, for example, by carrying a catalyst on the surface of a support material having a honeycomb structure. Applicable catalysts include manganese catalysts and precious metal catalysts. The catalyst decomposes toxic substances and odorous substances in the air from which dust has been removed by the passage through the dust collecting part (30).

The fan (14) is disposed at the most downstream site of the air passage (23) in the casing (20) and configured to draw room air into the casing (20) and then blow clean air to the room.

—Operational Behavior—

Next, a description is given of the air cleaning operation of the air cleaner (10).

As shown in FIGS. 1 and 2, when the air cleaner (10) activates the fan (14), room air is drawn into the air passage (23) in the casing (20) and flows through the air passage (23).

On the other hand, a direct-current voltage is applied between each ionizing wire and the associated opposed electrode in the charging part (12) and a direct-current voltage is also applied between the dust collecting electrode (40) and the high-voltage electrode (50).

When the room air is drawn into the air passage (23) in the casing (20), the prefilter (11) collects relatively large dust in the room air first.

The room air having passed through the prefilter (11) flows into the charging part (12). In the charging part (12), relatively small dust having passed through the prefilter (11) is charged with electricity to take a positive charge, for example, and the electrically charged dust flows downstream.

Subsequently, the electrically charged dust flows into the dust collecting part (30) and flows through the vent holes (46, 56) in the bases (41, 51) of the dust collecting electrode (40) and the high-voltage electrode (50). Specifically, the room air flows through the vent holes (46, 56) formed by the frames (43, 53), the vertical partitions and the horizontal partitions of the bases (41, 51) of the dust collecting electrode (40) and the high-voltage electrode (50) and flows around each of the projections (42, 52) of the dust collecting electrode (40) and the high-voltage electrode (50).

Since during the passage of room air the dust collecting electrode (40) serves as an earth electrode, for example, and is set to a negative electrode, the dust charged with positive electricity is adsorbed on the dust collecting electrode (40). Specifically, the dust is adsorbed on the inner surface of the frame (43) of the dust collecting electrode (40), the surfaces of the vertical partitions (44) thereof, the surfaces of the horizontal partitions (45) thereof and the surfaces of the projections (42) thereof.

Thereafter, the room air from which the dust has been removed flows through the catalyst filter (13), whereby toxic substances and odorous substances in the air are decomposed and clean air is thereby produced. The clean air passes through the fan (14) and is then blown through the air passage (23) to the room. The above operation is repeated to clean room air.

Effects of Embodiment 1

According to this embodiment, since each of the dust collecting electrode (40) and the high-voltage electrode (50) is composed of a base (41, 51) with a grid structure having a large number of vent holes (46, 56) formed therein and a large number of projections (42, 52) extending into the vent holes (56, 46) of the opposed electrode (50, 40), the dust collection area can be drastically increased as compared with the conventional parallel electrodes. As a result, the dust collector can be downsized and its dust collection performance can be enhanced.

Particularly, since the dust collecting electrode (40) and the high-voltage electrode (50) are made of an electroconductive resin, the occurrence of spark can be prevented and molding can be facilitated.

Furthermore, since each of the bases (41, 51) of the dust collecting electrode (40) and the high-voltage electrode (50) is formed in a rectangular grid in which a plurality of partitions (44, 54, 45, 55) are crisscrossed, the peripheral surface of each vent hole (46) of the dust collecting electrode (40) can be a dust collecting surface, which drastically increases the dust collection area.

Furthermore, since the projections (42) of the dust collecting electrode (40) extend into the associated vent holes (56) of the high-voltage electrode (50), they can serve as dust collecting surfaces, which further increases the dust collection area.

Since the horizontal partitions (45, 55) of the dust collecting electrode (40) and the high-voltage electrode (50) are alternately arranged in a staggered pattern, the projections (42, 52) can be extended into the associated vent holes (56, 46) of the opposed electrodes (50, 40), which increases the dust collection area.

Located in clearances between horizontally adjacent projections (42, 52) are the vertical partitions (54, 44) of the opposed electrodes (50, 40). Therefore, the projections (42, 52) can surely be extended, which increases the dust collection area.

Since the charging part (12) and the dust collecting part (30) are formed separately from each other, the polarities, the voltage and the interelectrode distance of the dust collecting electrode (40) and the high-voltage electrode (50) can be set to those suitable to the dust collecting part (30), which further enhances the dust collection performance.

Embodiment 2

Next, Embodiment 2 of the present invention is described in detail with reference to the drawings.

Figure 6:
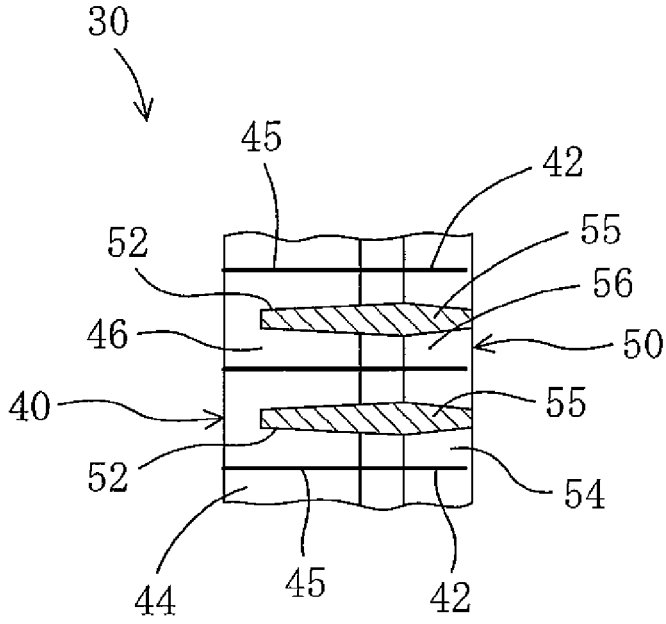
FIG. 6 is a cross-sectional side view showing part of a dust collecting part in Embodiment 2 of the present invention in magnified form.

In Embodiment 1, both the dust collecting electrode (40) and the high-voltage electrode (50) are made of an electroconductive resin. Instead of this, in this embodiment, the dust collecting electrode (40) is made of an electroconductive metal as shown in FIG. 6. Specifically, the dust collecting electrode (40) is formed of sheet metal made such as of stainless steel, while the high-voltage electrode (50) is made of an electroconductive resin like Embodiment 1.

Like Embodiment 1, the dust collecting electrode (40) is formed in a rectangular shape and includes a single base (41) and a large number of projections (42). The base (41) includes a frame (43), a plurality of vertical partitions (44) and a plurality of horizontal partitions (45). The projections (42), the frame (43), the vertical partitions (44) and the horizontal partitions (45) are formed of sheet metal made of an electroconductive metal.

The projections (42) of the dust collecting electrode (40), like Embodiment 1, extend into the associated vent holes (56) in the high-voltage electrode (50), while the projections (52) of the high-voltage electrode (50), like Embodiment 1, extend into the associated vent holes (46) in the dust collecting electrode (40).

Since in this embodiment the dust collecting electrode (40) is made of an electroconductive metal, its thickness can be smaller than that of the resin-made electrode. Therefore, the dust collection efficiency can be enhanced and the dust collector can be downsized as a whole. The rest of the structure and the other operations and effects are the same as in Embodiment 1.

Although in this embodiment the dust collecting electrode (40) and the high-voltage electrode (50) are made of an electroconductive metal and an electroconductive resin, respectively, the dust collecting electrode (40) and the high-voltage electrode (50) may be made of an electroconductive resin and an electroconductive metal, respectively.

Embodiment 3

Next, Embodiment 3 of the present invention is described in detail with reference to the drawings.

Figure 7:
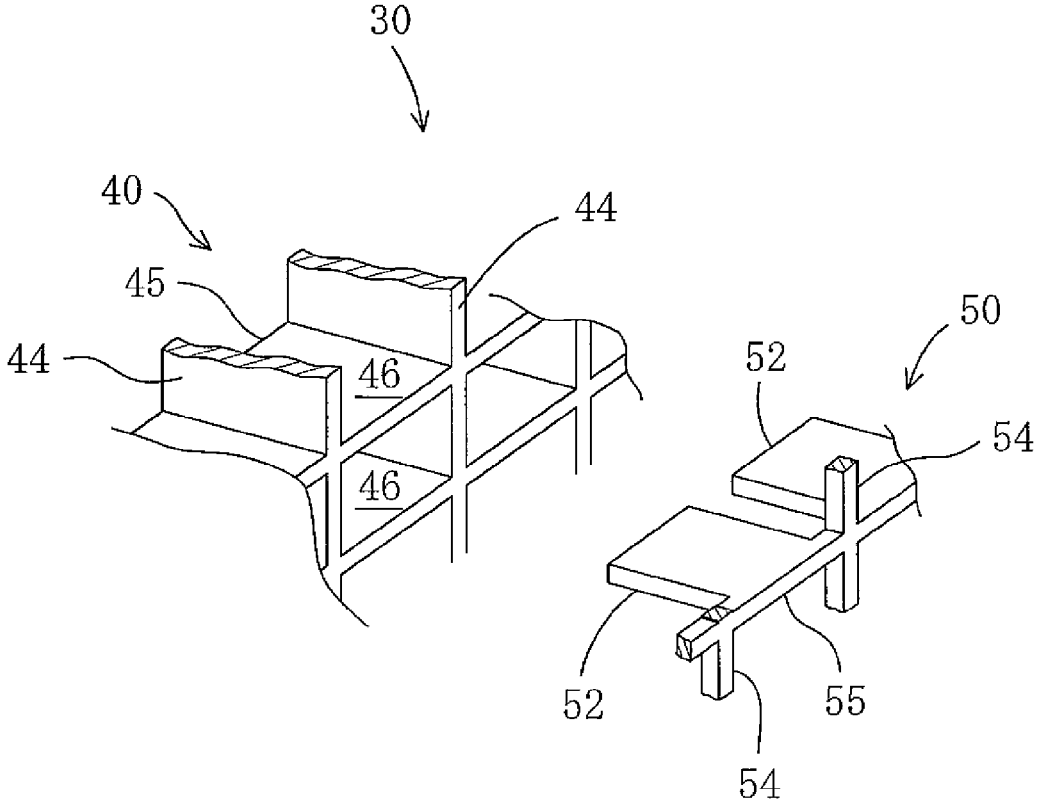
FIG. 7 is a perspective view showing part of a dust collecting part in Embodiment 3 of the present invention in magnified form.
Figure 8:
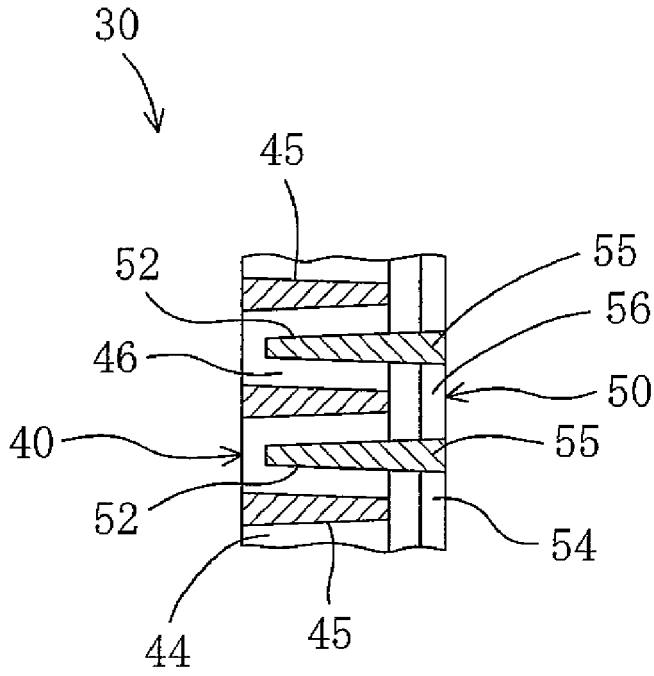
FIG. 8 is a cross-sectional side view showing part of the dust collecting part in Embodiment 3 of the present invention in magnified form.

In Embodiment 1, the dust collector is configured so that the dust collecting electrode (40) and the high-voltage electrode (50) fit into each other Instead of this, in this embodiment, the dust collector is configured so that only the high-voltage electrode (50) fits into the dust collecting electrode (40) as shown in FIGS. 7 and 8.

Specifically, the dust collecting electrode (40) is formed in a rectangular shape and includes a base (41). The base (41) includes a frame (43), a plurality of vertical partitions (44) and a plurality of horizontal partitions (45). Thus, the dust collecting electrode (40) in this embodiment does not include any projections (42) as in Embodiment 1 and is simply formed in a grid structure.

On the other hand, the high-voltage electrode (50), like Embodiment 1, is formed in a rectangular shape and includes a single base (51) and a large number of projections (52). In this case, the base (51) of the high-voltage electrode (50) is formed so that its thickness in the direction of air flow is smaller than that in Embodiment 1. Specifically, the base (51) includes a frame (53), a plurality of vertical partitions (54) and a plurality of horizontal partitions (55) but is formed to have a small thickness in the direction of air flow.

In other words, since the dust collecting electrode (40) includes no projection, the frame (53), the vertical partitions (54) and the horizontal partitions (55) of the high-voltage electrode (50) are formed with enough thickness to hold the large number of projections (52).

Therefore, only the projections (52) of the high-voltage electrode (50) extend into the respective vent holes (46) in the dust collecting electrode (40). The rest of the structure, including that both the dust collecting electrode (40) and the high-voltage electrode (50) are made of an electroconductive resin, is the same as in Embodiment 1.

Embodiment 4

Next, Embodiment 4 of the present invention is described in detail with reference to the drawings.

Figure 9:
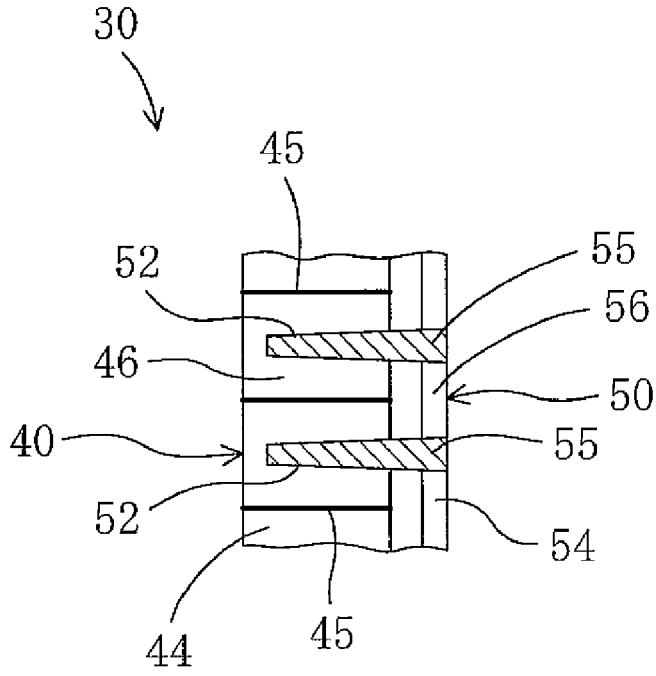
FIG. 9 is a cross-sectional side view showing part of a dust collecting part in Embodiment 4 of the present invention in magnified form.

In Embodiment 3, both the dust collecting electrode (40) and the high-voltage electrode (50) are made of an electroconductive resin. Instead of this, in this embodiment, the dust collecting electrode (40) is made of an electroconductive metal as shown in FIG. 9.

Specifically, the dust collecting electrode (40) is, like Embodiment 2, formed of sheet metal made such as of stainless steel, while the high-voltage electrode (50) is, like Embodiment 1, made of an electroconductive resin.

Like Embodiment 3, the dust collecting electrode (40) is formed in a rectangular shape and includes a base (41) only. The base (41) includes a frame (43), a plurality of vertical partitions (44) and a plurality of horizontal partitions (45). The frame (43), the vertical partitions (44) and the horizontal partitions (45) are formed of sheet metal made of an electroconductive metal.

Furthermore, like Embodiment 3, only the projections (52) of the high-voltage electrode (50) extend into the respective vent holes (46) in the dust collecting electrode (40).

Since in this embodiment the dust collecting electrode (40) is made of an electroconductive metal, its thickness can be smaller than that of the resin-made electrode. Therefore, the dust collection efficiency can be enhanced and the dust collector can be downsized as a whole. The rest of the structure and the other operations and effects are the same as in Embodiment 3.

Although in this embodiment the dust collecting electrode (40) and the high-voltage electrode (50) are made of an electroconductive metal and an electroconductive resin, respectively, the dust collecting electrode (40) and the high-voltage electrode (50) may be made of an electroconductive resin and an electroconductive metal, respectively.

Embodiment 5

Next, Embodiment 5 of the present invention is described in detail with reference to the drawings.

Figure 10:
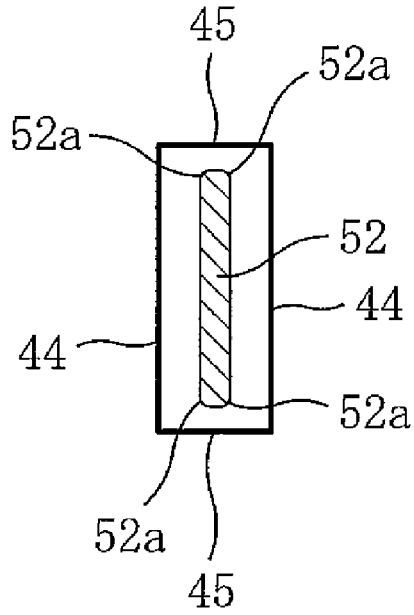
FIG. 10 is a cross-sectional front view showing part of a dust collecting part in Embodiment 5 of the present invention in magnified form.
Figure 11:
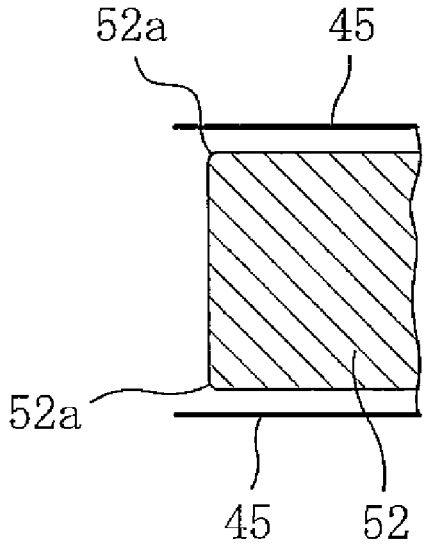
FIG. 11 is a cross-sectional side view showing part of the dust collecting part in Embodiment 5 of the present invention in magnified form.

In this embodiment, as shown in FIGS. 10 and 11, the distal end corners of the projections (52) of the high-voltage electrode (50) are formed in arcuate shape, instead of being formed with acute angles in Embodiment 4.

Specifically, the distal end corners of each projection (52) of the high-voltage electrode (50) are formed in arcuate shape in end view from the distal end and formed in arcuate shape in right and left side views, plan view and bottom view, thereby forming arcuate parts (52*a*).

Since in this embodiment the distal end corners of each projection (52) are formed into arcuate parts (52*a*), flashes or the like can surely be removed, which surely prevents the occurrence of abnormal discharge such as due to flashes.

The rest of the structure and the other operations and effects are the same as in Embodiment 3. Furthermore, it is a matter of course that such arcuate parts (52*a*) as in this embodiment may be formed at the distal end corners of each projection (42) of the dust collecting electrode (40) in Embodiment 1.

Embodiment 6

Next, Embodiment 6 of the present invention is described in detail with reference to the drawings.

Figure 12:
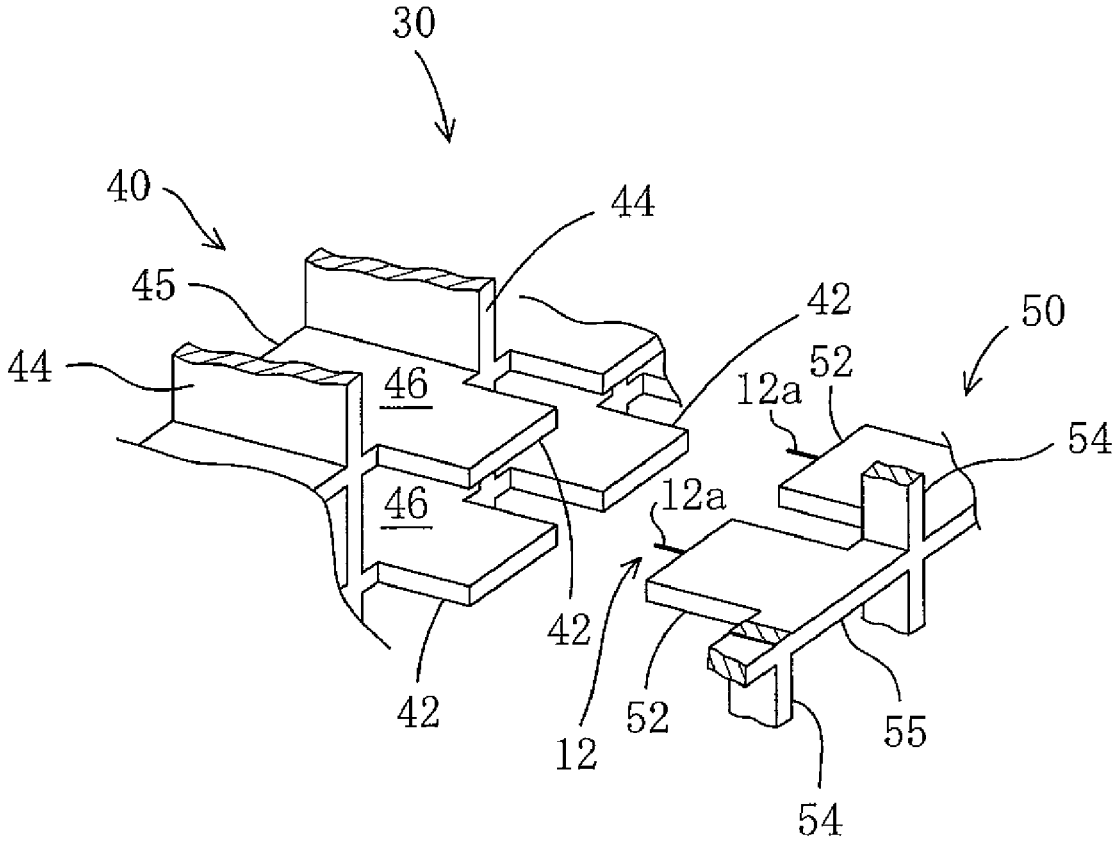
FIG. 12 is a perspective view showing part of a dust collecting part in Embodiment 6 of the present invention in magnified form.
Figure 13:
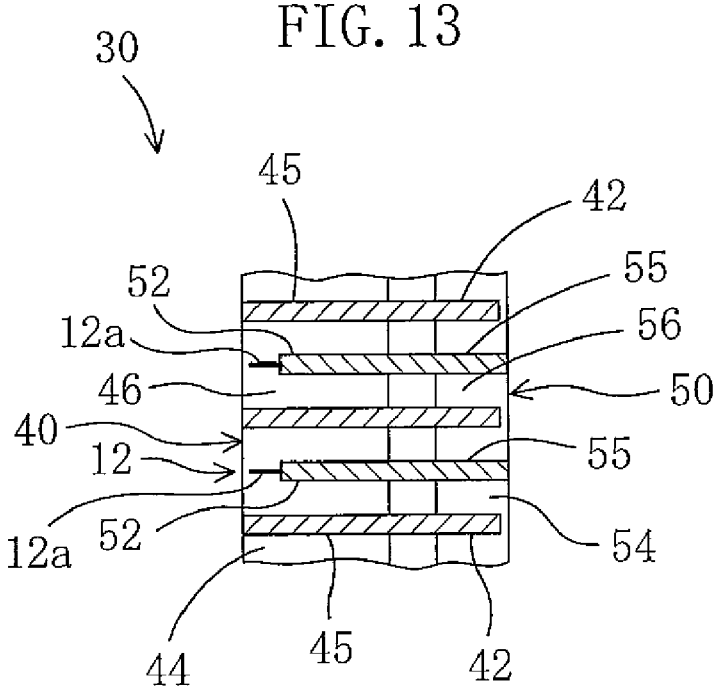
FIG. 13 is a cross-sectional side view showing part of the dust collecting part in Embodiment 6 of the present invention in magnified form.

In this embodiment, as shown in FIGS. 12 and 13, the charging part (12) and the dust collecting part (30) are formed integrally with each other, instead of being formed separately from each other in Embodiment 1.

Specifically, the charging part (12) includes needle-shaped ionizing electrodes (12*a*). Each ionizing electrode (12*a*) is formed integrally with the high-voltage electrode (50) at the end surface of one of the projections (52) of the high-voltage electrode (50) to extend frontward. Furthermore, each ionizing electrode (12*a*) is located within the associated vent hole (46) in the dust collecting electrode (40) and surrounded by the associated vertical partitions (44) and horizontal partitions (45) of the dust collecting electrode (40), and parts of the vertical partitions (44) and parts of the horizontal partitions (45) constitute an opposed electrode to the ionizing electrode (12*a*). The charging part (12) is configured so that a direct-current voltage is applied between each ionizing electrode (12*a*) and the parts of the adjacent vertical partitions (44) and horizontal partitions (45) of the dust collecting electrode (40). The rest of the structure is the same as in Embodiment 1.

Therefore, in this embodiment, the room air having passed through the prefilter (11) flows into the charging part (12). In the charging part (12), an electrical discharge occurs between each ionizing electrode (12*a*) and the dust collecting electrode (40), whereby dust is charged with electricity, for example, positive electricity. The electrically charged dust flows through the dust collecting part (30). Specifically, the dust flows through the vent holes (46, 56) in the dust collecting electrode (40) and the high-voltage electrode (50). Since the dust collecting electrode (40) serves as an earth electrode, for example, and is set to a negative electrode, the dust charged with positive electricity is adsorbed on the dust collecting electrode (40).

According to this embodiment, since the charging part (12) and the dust collecting part (30) are formed integrally, one electrode can be used for two purposes, which provides an entirely downsized dust collector. The other operations and effects are the same as in Embodiment 1.

Also in this embodiment, the dust collecting electrode (40) or the high-voltage electrode (50) may be formed of sheet metal made such as of stainless steel like Embodiment 2, the projections (42) of the dust collecting electrode (40) may be dispensed with like Embodiments 3 and 4, or the arcuate parts (52*a*) may be provided like Embodiment 5.

Other Embodiments

Each of the above embodiments of the present invention may have the following configurations.

Although in the above embodiments the dust collecting electrode (40) has a large number of vent holes (46) formed therein, it may have a single vent hole while the high-voltage electrode (50) may have a single projection (52) in correspondence with the vent hole (46).

In Embodiments 1 and 2, both the dust collecting electrode (40) serving as a first electrode and the high-voltage electrode (50) serving as a second electrode include projections (42, 52) and the first electrode (40) and the second electrode (50) are configured to fit into each other. However, the present invention is sufficient if, like Embodiment 3, only the high-voltage electrode (50) include at least one projection (52) and is configured to fit into the dust collecting electrode (40) or if only the dust collecting electrode (40) include at least one projection (42) and is configured to fit into the high-voltage electrode (50).

Although in the above embodiments the bases (41, 51) of the dust collecting electrode (40) and the high-voltage electrode (50) are formed in a rectangular grid structure, they may be formed in a square grid structure, a hexagonal grid structure or a triangular grid structure. In short, the bases (41, 51) are sufficient if they are formed in any type of grid structure to extend the dust collection area.

Although in the above embodiments the projections (42, 52) are formed on the horizontal partitions (45, 55), they may be formed on the vertical partitions (44, 54). It is a matter of course that the projections (42, 52) may have any one of various shapes including a bar shape as well as a flat-plate shape.

In Embodiments 1 to 6, there is also the case where the high-voltage electrode (50) is set to a negative high-voltage electrode and the dust collecting electrode (40) is set to an earth electrode.

Although in Embodiments 1 to 5 the charging part (12) is composed of ionizing wires and their opposed electrodes, needle-shaped electrodes may be used instead of the ionizing wires. In this case, for example, the needle electrodes and the opposed electrodes may be set to negative high-voltage electrodes and earth electrodes, respectively.

The dust collecting electrode (40) may be a positive electrode. In this case, the opposed electrode (50) serves as an earth electrode.

The dust collector of the present invention is not limited to application to an air cleaner (10), may be assembled in an air conditioner and may include only a charging part (12) and a dust collecting part (30).

The above embodiments are merely preferred embodiments in nature and are not intended to limit the scope, applications and use of the invention.

INDUSTRIAL APPLICABILITY

As can be seen from the above description, the present invention is useful for various types of dust collectors including household dust collectors.

The invention claimed is:

1. A dust collector, including a first electrode and a second electrode, for collecting electrically charged dust by applying a predetermined voltage between the first electrode and the second electrode, at least one of the first electrode and the second electrode being made of an electroconductive resin, the first electrode being configured to surround the second electrode, wherein each of the first electrode and the second electrode includes a base, and each of the bases of the first electrode and the second electrode is formed in a rectangular grid structure in which a plurality of partitions are crisscrossed.

2. A dust collector, including a first electrode and a second electrode that are placed in an air passage, for collecting electrically charged dust by applying a predetermined voltage between the first electrode and the second electrode, at least one of the first electrode and the second electrode being made of an electroconductive resin, the first electrode and the second electrode being configured to create a radial electric field in the cross section of the air passage, wherein each of the first electrode and the second electrode includes a base, and each of the bases of the first electrode and the second electrode is formed in a rectangular grid structure in which a plurality of partitions are crisscrossed.

3. A dust collector, including a first electrode and a second electrode, for collecting electrically charged dust in the air by applying a predetermined voltage between the first electrode and the second electrode, at least one of the first electrode and the second electrode (50) being made of an electroconductive resin, the first electrode including a tubular part forming a vent hole opening at the front and back surfaces thereof, the second electrode having a projection formed thereon to extend at least into the vent hole of the first electrode, wherein each of the first electrode and the second electrode includes a base, and each of the bases of the first electrode and the second electrode is formed in a rectangular grid structure in which a plurality of partitions are crisscrossed.

4. The dust collector of claim 3, wherein the first electrode is formed in a grid structure having a large number of the vent holes formed therein, and the second electrode has a large number of the projections formed thereon in correspondence with the respective vent holes of the first electrode.

5. The dust collector of claim 4, wherein the first electrode includes: the base with the grid structure having a large number of the vent holes formed therein; and a large number of projections extending from the base in parallel to the axial direction of the vent holes, the second electrode includes the base with the grid structure opposed to the base of the first electrode and having a large number of vent holes formed therein to open at the front and back surfaces thereof, the projections of the second electrode project from the base in parallel to the axial direction of the vent holes, and the projections of the first electrode extend into the respective vent holes of the second electrode.

6. The dust collector of claim 5, wherein each of the vertical partitions of the first electrode is located to form the same plane with an associated one of the vertical partitions of the second electrode, and the horizontal partitions of the first electrode and the horizontal partitions of the second electrode are alternately arranged in a vertically staggered pattern.

7. The dust collector of claim 5, wherein the projections of each of the first electrode and the second electrode project from the horizontal partitions and each of the vertical partitions of the base of the electrode opposed to the projections is located in a clearance between horizontally adjacent two of the projections.

8. The dust collector of any one of claims 1 to 3, wherein the first electrode and the second electrode are made of an electroconductive resin.

9. The dust collector of any one of claims 1 to 3, wherein the first electrode is made of an electroconductive metal, and the second electrode is made of an electroconductive resin.

10. The dust collector of any one of claims 1 to 3, wherein the first electrode is made of an electroconductive resin, and the second electrode is made of an electroconductive metal.

11. The dust collector of any one of claims 1 to 3, further including a charging part for charging dust in the air with electricity, wherein the first electrode and the second electrode are provided separately from the charging part and constitute a dust collecting part for collecting the dust charged with electricity by the charging part.

12. The dust collector of any one of claims 1 to 3, wherein the first electrode and the second electrode constitute, as an integral piece, a charging part for charging dust in the air with electricity and a dust collecting part for collecting the dust charged with electricity by the charging part.

13. The dust collector of claim 3, wherein the second electrode is made of an electroconductive resin, and the distal end corners of the projections of the second electrode are formed in arcuate shape.

* * * * *